US012501950B2

(12) United States Patent
Conerly, Jr.

(10) Patent No.: US 12,501,950 B2
(45) Date of Patent: Dec. 23, 2025

(54) FIRE RETARDANT BIB ASSEMBLY

(71) Applicant: Glean Conerly, Jr., Los Angeles, CA (US)

(72) Inventor: Glean Conerly, Jr., Los Angeles, CA (US)

( * ) Notice: Subject to any disclaimer, the term of this patent is extended or adjusted under 35 U.S.C. 154(b) by 381 days.

(21) Appl. No.: 18/072,072

(22) Filed: Nov. 30, 2022

(65) Prior Publication Data

US 2024/0172818 A1 May 30, 2024

(51) Int. Cl.
*A41D 13/04* (2006.01)
*A24F 47/00* (2020.01)
*A41D 31/08* (2019.01)

(52) U.S. Cl.
CPC ..... *A41D 13/04* (2013.01); *A24F 47/00* (2013.01); *A41D 31/08* (2019.02)

(58) Field of Classification Search
CPC ..... A41D 13/04; A41B 13/10; A41B 13/103; A24F 47/00
USPC ..... 131/329
See application file for complete search history.

(56) References Cited

U.S. PATENT DOCUMENTS 5,220,692 A 6/1993 Cox
5,819,314 A * 10/1998 Jackson ..... A41B 13/10 2/243.1
6,718,554 B1 * 4/2004 Langston ..... A41B 13/103 2/49.1
7,269,855 B2 9/2007 LaRocco
7,451,494 B2 11/2008 Monroe
D726,395 S 4/2015 Lewis
2002/0069446 A1 6/2002 Pinckney
2004/0128729 A1 7/2004 Lat
2006/0174390 A1 * 8/2006 Wakhloo ..... A41D 13/04 2/48
2008/0209608 A1 9/2008 Sheffield
2015/0173434 A1 6/2015 Sabre

FOREIGN PATENT DOCUMENTS

DE 0307715 A1 * 3/1989 ..... A41D 13/04
KR 200439973 Y1 * 5/2008 ..... A41D 13/04
WO WO2008144260 11/2008

OTHER PUBLICATIONS

English translation of EP-0307715-A1.*
English translation of KR-200439973-Y1.*

* cited by examiner

*Primary Examiner* — Michael H. Wilson
*Assistant Examiner* — Michael Patrick Mullen

(57) ABSTRACT

A fire retardant bib assembly for being wearable around a neck of a person who is smoking includes a bib being wearable around a neck of a person who is smoking and being elongated to cover a torso of the person to inhibit ash created by an article being smoked from falling onto clothing of the person. The bib comprises a flexible fabric composed of a fire resistant material. The bib has a pair of weighted members, a pair of tethers, and a pocket. The pocket is coupled to the bib and includes an open end.

4 Claims, 6 Drawing Sheets

FIRE RETARDANT BIB ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bib and more particularly pertains to a new bib for being wearable around a neck of a person who is smoking.

(2) Description of Related Art Including Information Disclosed Under 37 CFR 1.97 and 1.98

The prior art relates to bibs and includes a variety of bibs being configured for protecting clothing of the user. The prior art further includes a variety of bibs being fire retardant. Known prior art does not include a bib being fire retardant and having a pair of weighted members and a pair of tethers facilitating securing the bib to a person who is smoking.

BRIEF SUMMARY OF THE INVENTION

An embodiment of the disclosure meets the needs presented above by generally comprising a bib. The bib is wearable around a neck of a person who is smoking and is elongated to cover a torso of the person to inhibit ash created by an article being smoked from falling onto clothing of the person. The bib comprises a flexible fabric composed of a fire resistant material. The bib has a pair of weighted members, a pair of tethers, and a pocket. The pocket is coupled to the bib and includes an open end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
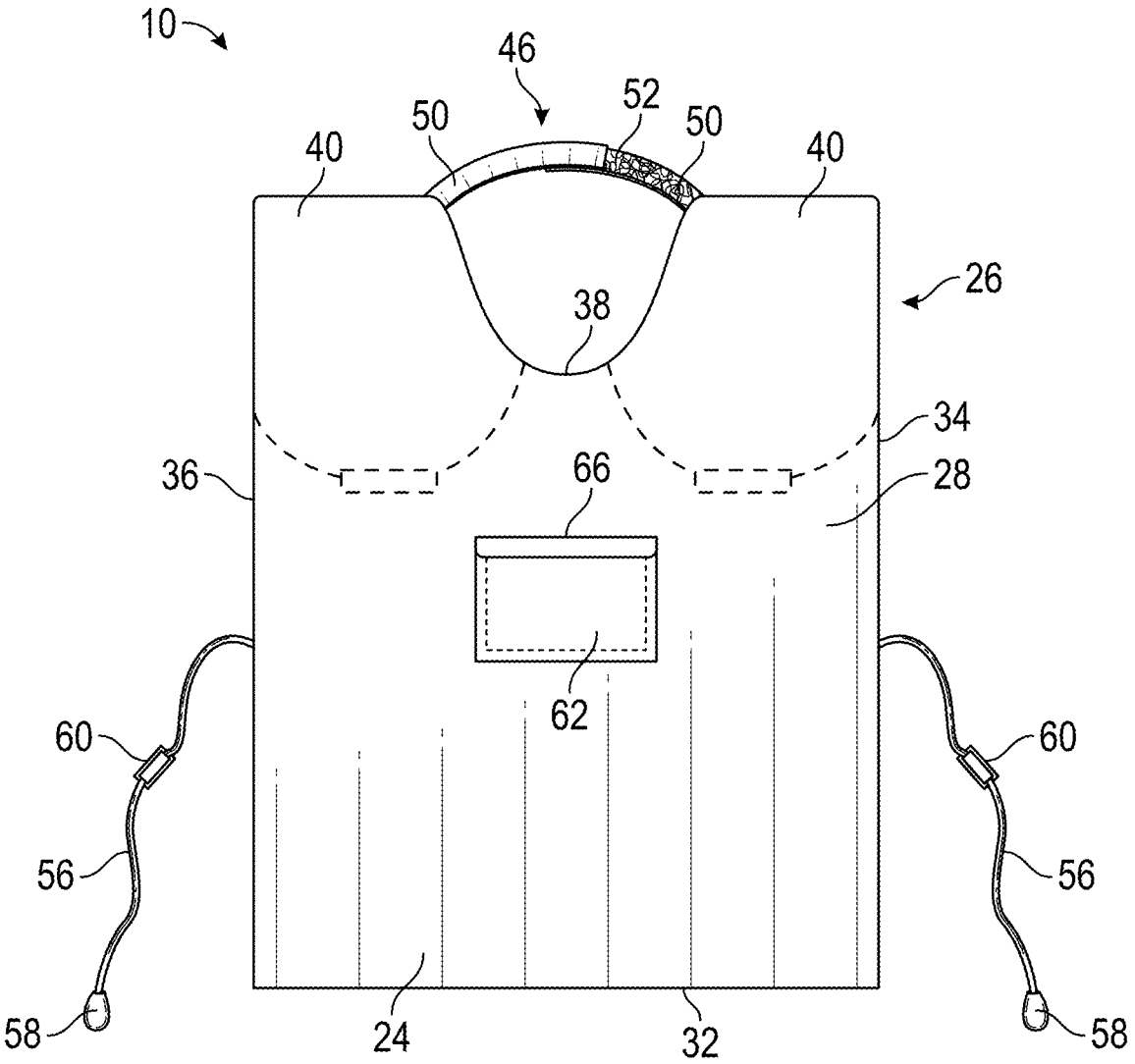
FIG. 1 is a front view of a fire retardant bib assembly according to an embodiment of the disclosure.
Figure 2:
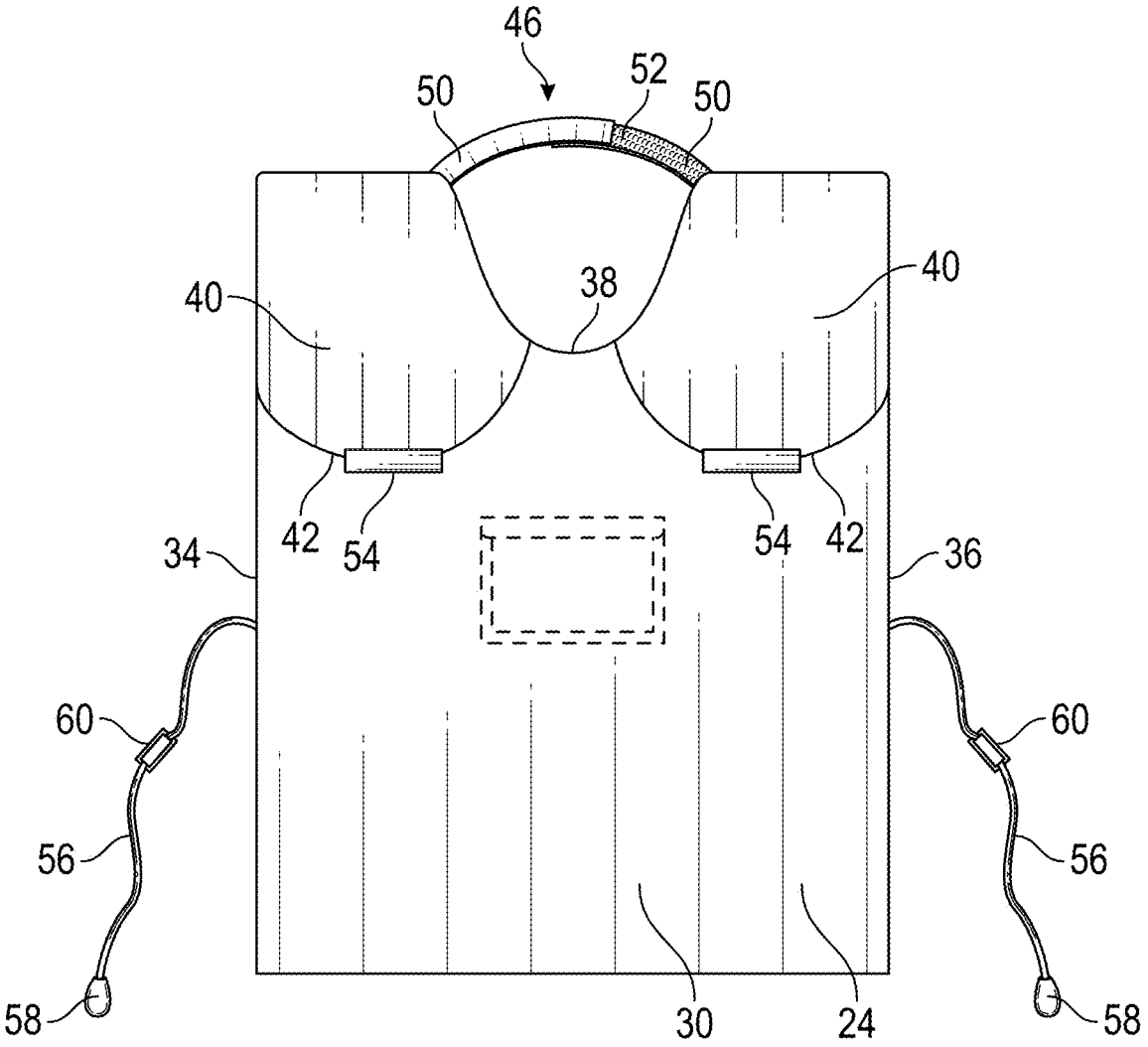
FIG. 2 is a back view of an embodiment of the disclosure.
Figure 3:
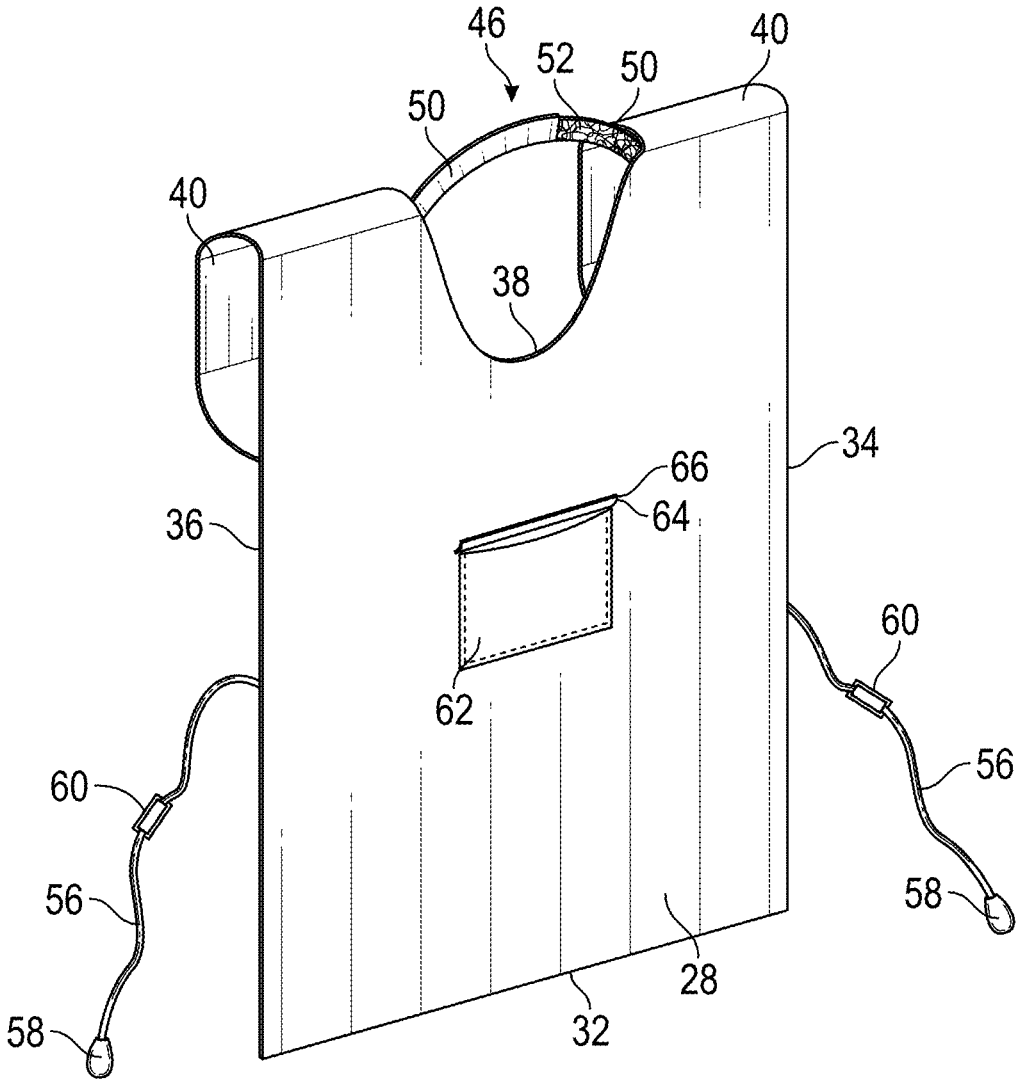
FIG. 3 is a top isometric view of an embodiment of the disclosure.
Figure 4:
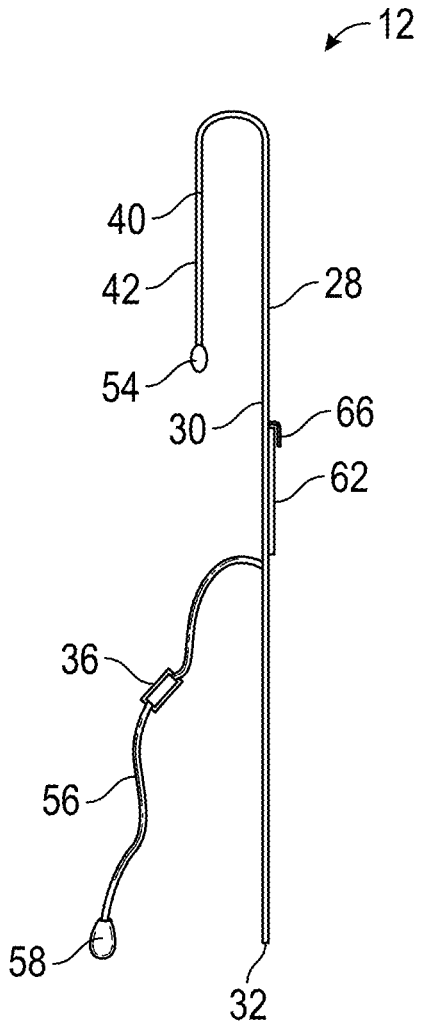
FIG. 4 is a side view of an embodiment of the disclosure.
Figure 5:
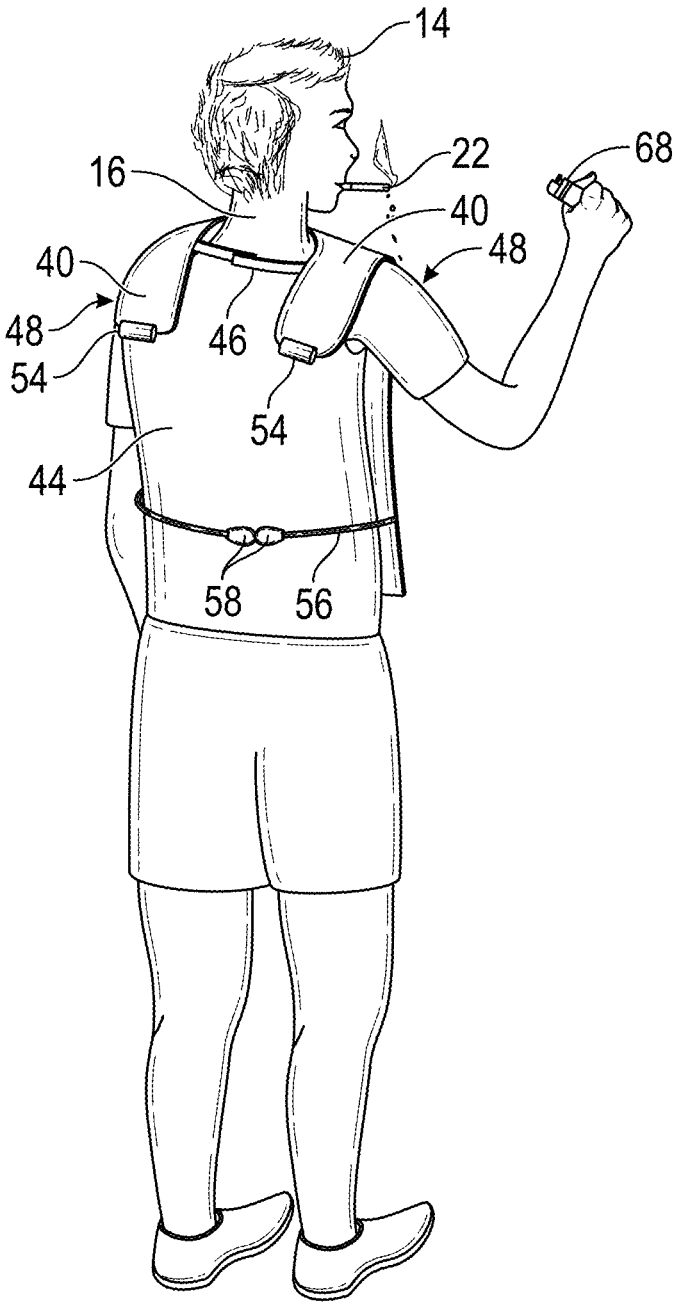
FIG. 5 is a back in-use view of an embodiment of the disclosure.
Figure 6:
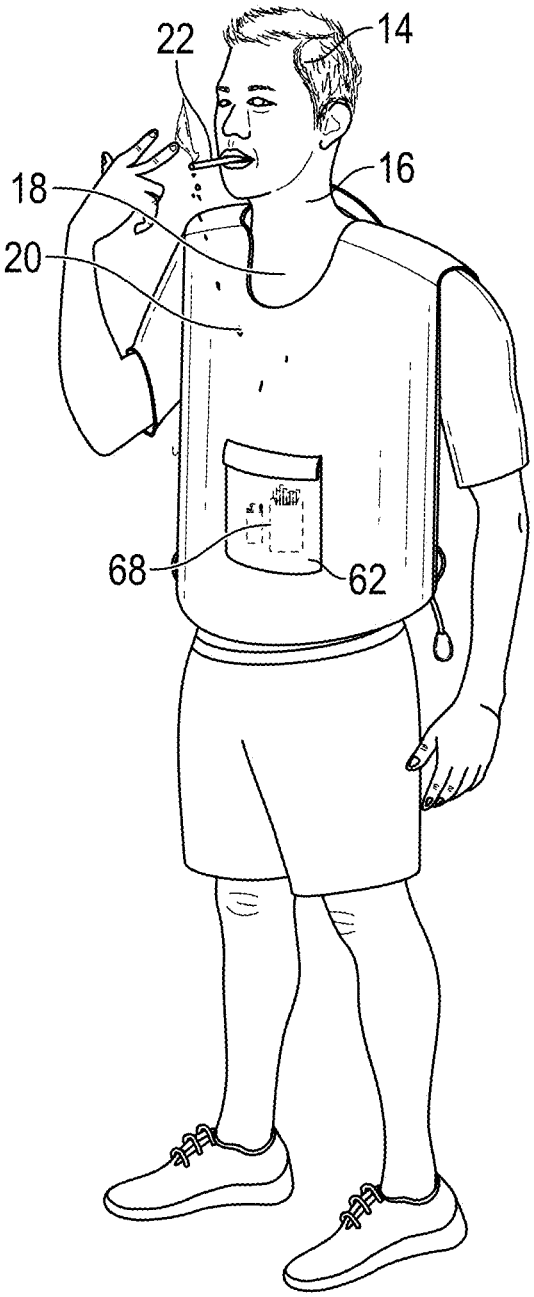
FIG. 6 is a front in-use view of an embodiment of the disclosure.

With reference now to the drawings, and in particular to FIGS. 1 through 6 thereof, a new bib embodying the principles and concepts of an embodiment of the disclosure and generally designated by the reference numeral 10 will be described.

As best illustrated in FIGS. 1 through 6, the fire retardant bib assembly 10 generally comprises a bib 12. The bib 12 is wearable around a neck 16 of a person 14 who is smoking and is elongated to cover a torso 18 of the person 14 to inhibit ash 20 created by an article being smoked 22 from falling onto clothing of the person 14. The bib 12 typically comprises a flexible fabric composed of a fire resistant material 24, which may include any conventional material used in clothing as a fire retardant material such as, for example, aramid polymers.

The bib 12 includes a panel 26 including a front surface 28, a rear surface 30, a bottom edge 32, a first side edge 34, a second side edge 36, and a top edge 38. The rear surface 30 is abuttable against the torso 18 of the person 14, wherein the front surface 28 is positionable facing away from the person 14. A pair of flaps 40 is coupled to the top edge 38 and protrudes out therefrom. The flaps 40 are removably abuttable against the shoulders 48 of the person 14, wherein an end 42 of each flap 40 is removably positionable on a back 44 of the person 14. One of the flaps 40 is positioned adjacent to the first side edge 34 and one of the flaps 40 is positioned adjacent to the second side edge 36. A fastener 46 is coupled to the flaps 40 and releasably fastens the flaps 40 to each other. The fastener 46 is releasably fastenable behind a back of the neck 16 of the person 14 when the flaps 40 are positioned on the shoulders 48 of the person 14, wherein the fastener 46 facilitates securing the panel 26 to the person 14. The fastener 46 may include a pair of strap members 50 being coupled to a respective one of the pair of flaps 40. The strap members 50 are releaseably securable to each other and may have a hook and loop fastener 52 or another conventional fastener for being releaseably securable to each other.

The bib 12 has a pair of weighted members 54 and each flap 40 has one of the weighted members 54 being coupled thereto. The weighted members 54 facilitate securing the bib 12 to the person 14 by weighing the bib 12 downwardly onto the person 14. The bib 12 has pair of tethers 56 and one of the tethers 56 is coupled to the first side edge 34 and one of the tethers 56 is coupled to the second side edge 36. The pair of tethers 56 is positionable behind the back 44 of the person 14 and each tether 56 has a coupler 58 for releasably securing the tethers 56 to each other. The coupler 58 may comprise a magnet, wherein each coupler 58 is engageable by magnetism to each other. Each tether 56 may have an adjustment member 60 to adjust a length of each tether 56 relative to the bib 12. The adjustment member 60 may comprise a buckle or another conventional adjuster.

A pocket 62 is coupled to the bib 12 and includes an open end 64. The pocket 62 is positioned in a center of the front surface 28 and the open end 64 typically faces towards the top edge 38. A fold 66 is positioned adjacent to the open end 64 of the pocket 62 and removably closes the open end 64 of the pocket 62. The pocket 62 may removably store articles related to smoking 68 such as a lighter or a pack of cigarettes.

In use, the rear surface 30 of the panel 26 is abutted to the torso 18 of the person 14 who is smoking, and the pair of flaps 40 is abutted to the shoulders 48 of the person 14. The fastener 46 is securable behind the neck 16 of the person 14 thereafter and the pair of tethers 56 may be secured to each other behind the person 14 to facilitate securing the bib 12 to the person 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A smoking shield assembly configured to prevent ash from accumulating upon a garment of a user, said smoking shield assembly comprising:

a bib being wearable around a neck of a person who is smoking and being elongated to cover a torso of the person to inhibit ash created by an article being smoked from falling onto clothing of the person, said bib comprising a flexible fabric composed of a fire resistant material, said bib including:

a panel having a top edge, a first side edge, and a second side edge, said top edge including:

a first straight member extending from a junction between said top edge and said first side edge toward said second side edge;

a second straight member extending from a junction between said top edge and said second side edge toward said first side edge; and an arcuate member extending between said first straight member and said second straight member, said arcuate member being concavely arcuate;

a pair of flaps being coupled to said top edge of said panel and protruding out therefrom, said flaps being removably abuttable against shoulders of the person, wherein an end of each flap is removably positionable on a back of the person, one of said flaps being positioned adjacent to said first side edge and the other of said flaps being positioned adjacent to a second side edge wherein each flap of said pair of flaps protrudes from a respective one of said first straight member and said second straight member; and a fastener being coupled to said flaps and releasably fastening said flaps to each other, said fastener including a pair of strap members being coupled to a respective one of said pair of flaps, each strap member of said pair of strap members extending from a junction between said respective one of said pair of flaps and said arcuate member of said top edge of said panel, each strap member of said pair of strap members having an upper edge and a lower edge, said upper edge being convexly arcuate and said lower edge being concavely arcuate wherein said fastener is configured to be releasably fastenable behind a back of the neck of the person when said flaps are positioned on said shoulders of the person and said arcuate member of said top edge of said panel is positioned in front of a chest of the person, said strap members being releaseably securable to each other;

a pair of weighted members, each flap having one of said weighted members being coupled thereto wherein said pair of weighted members are configured to secure a position of said pair of flaps against a back of the person;

a pair of tethers extending from said panel, each tether having an adjustment member for adjusting a length of each tether relative to said bib whereby a rear surface of said panel is abuttable against the torso of the person; and a pocket being coupled to said bib and including an open end.

2. The smoking shield assembly of claim 1, wherein one of said tethers is coupled to said first side edge and one of said tethers is coupled to said second side edge, said pair of tethers being positionable behind the back of the person, each tether having a coupler for releasably securing said tethers to each other.

3. The smoking shield assembly of claim 1, wherein said pocket is positioned in a center of a front surface of said panel, said open end facing towards said top edge of said panel, a fold being positioned adjacent to said open end of said pocket and being configured to removably close said open end of said pocket.

4. A smoking shield assembly configured to prevent ash from accumulating upon a garment of a user, said smoking shield assembly comprising:

a bib being wearable around a neck of a person who is smoking and being elongated to cover a torso of the person to inhibit ash created by an article being smoked from falling onto clothing of the person, said bib comprising a flexible fabric composed of a fire resistant material, said bib including:

a panel including a front surface, a rear surface, a bottom edge, a first side edge, a second side edge, and a top edge, said rear surface being abuttable against the torso of the person, said top edge including:

a first straight member extending from a junction between said top edge and said first side edge toward said second side edge;

a second straight member extending from a junction between said top edge and said second side edge toward said first side edge; and an arcuate member extending between said first straight member and said second straight member, said arcuate member being concavely arcuate;

a pair of flaps being coupled to said top edge and protruding out therefrom, said flaps being removably abuttable against shoulders of the person, wherein an end of each flap is removably positionable on a back of the person, one of said flaps being positioned adjacent to said first side edge and the other of said flaps being positioned adjacent to said second side edge wherein each flap of said pair of flaps protrudes from a respective one of said first straight member and said second straight member of said top edge of said panel; and a fastener being coupled to said flaps and releasably fastening said flaps to each other, said fastener including a pair of strap members being coupled to said pair of flaps, each strap member of said pair of strap members extending from a junction between a respective one of said pair of flaps and said arcuate member of said top edge of said panel, each strap member of said pair of strap members having an upper edge and a lower edge, said upper edge being convexly arcuate and said lower edge being concavely arcuate wherein said fastener is configured to be releasably fastenable behind a back of the neck of the person when said flaps are positioned on said shoulders of the person and said arcuate member of said top edge of said panel is positioned in front of a chest of the person wherein said fastener facilitates securing said panel to the person, said strap members being releaseably securable to each other;

a pair of weighted members, each flap having one of said weighted members being coupled thereto wherein said pair of weighted members are configured to secure a position of said pair of flaps against a back of the person;

a pair of tethers extending from the panel, one of said tethers being coupled to said first side edge and one of said tethers being coupled to said second side edge, said pair of tethers being positionable behind the back of the person, each tether having a coupler for releasably securing said tethers to each other, each tether having an adjustment member for adjusting a length of each tether relative to said bib whereby said rear surface of said panel is abuttable against the torso of the person; and a pocket being coupled to said bib and including an open end, said pocket being positioned in a center of said front surface, said open end facing towards said top edge, a fold being positioned adjacent to said open end of said pocket and being configured to removably close said open end of said pocket.

* * * * *